United States Patent [19]

Harris

[11] Patent Number: 4,825,478

[45] Date of Patent: May 2, 1989

[54] FLUSH TANK WATER SAVER

[76] Inventor: John L. Harris, 470 Palm Island, NE, Clearwater, Fla. 34630

[21] Appl. No.: 96,058

[22] Filed: Sep. 14, 1987

[51] Int. Cl.[4] ..... E03D 1/00

[52] U.S. Cl. ..... 4/415; 4/381

[58] Field of Search ..... 4/415, 324, 325, 391–397, 4/381–387, 405, 378, 379, 427

[56] References Cited

U.S. PATENT DOCUMENTS

| | | | |
|---|---|---|---|
| 96,058 | 4/1883 | Scott | 4/415 |
| 823,832 | 11/1906 | Wayman | 4/381 |
| 2,583,468 | 1/1952 | Castellano | 4/324 |
| 3,026,536 | 3/1964 | Wood | 4/DIG. 1 |
| 4,032,997 | 7/1977 | Phripp et al. | 4/324 |
| 4,135,261 | 1/1979 | Overbey | 4/222 |
| 4,388,737 | 6/1983 | Wenzel | 4/324 |
| 4,483,024 | 11/1984 | Troeh | 4/324 |

*Primary Examiner*—A. D. Pellinen
*Assistant Examiner*—Morris Ginsburg

[57] ABSTRACT

A water saver outlet valve mechanism for a flush tank includes a latch for holding the valve open when pulled open by the flush handle. This latch is released by a float either at a water saving intermediate level, or when the tank is empty for a full flush, as selected by the user. A full flush is obtained by retracting an operator for the latch to an inoperative position at the water saving level, allowing the float to pass without releasing the latch. This retraction is done when the flush lever is pushed to start a flush. The float locks the latch in retracted position if the water level drops a predetermined amount before the flush lever is released.

20 Claims, 4 Drawing Sheets

FIG. 2A
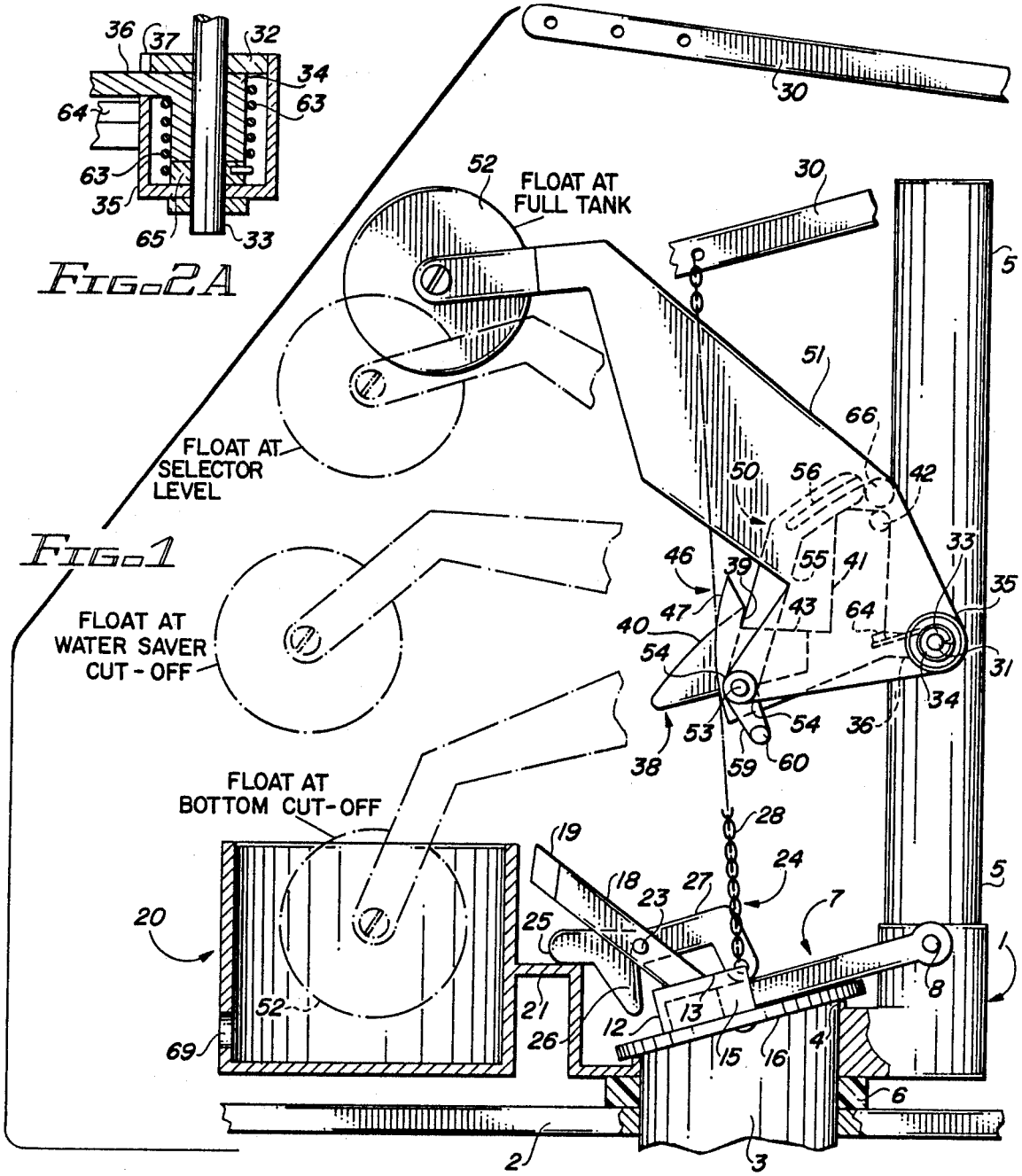
FIG. 1
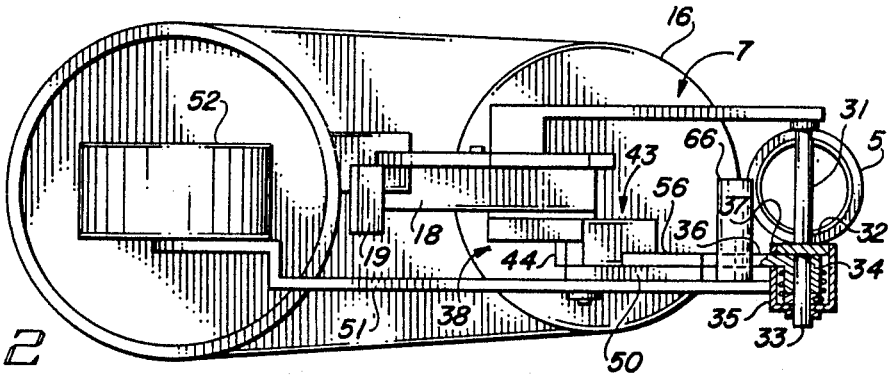
FIG. 2

FLUSH TANK WATER SAVER

BACKGROUND OF THE INVENTION

This invention relates to toilet tank controls for selectively providing a water saving flush or a full flush.

It has long been recognized that toilet flush tanks are one of the worst water wasters in existence. They are flushed often and each time use a full tank of water even though less than half would give an adequate flush for most uses.

Many attempts have been made to develop suitable devices giving the user a choice between a short flush and a full flush. However, none has been marketable.

This application is a continuation of the developments disclosed in my applications Ser. No. 07/030080 filed Mar. 26, 1987 and 07/067494 filed June 29, 1987.

Those prior applications are for attachments to existing flush tank valves to provide water savings. These attachments include a float controlled means for pushing the outlet valve closed at a water saving level. In order to provide a full flush a locking means controlled by the user stops the float before the water saving cut-off point is reached.

SUMMARY OF THE INVENTION

The present invention includes a flush control for use in new equipment. It is a device in which a single float closes the flush valve for either a water saving flush or a full flush as selected by the user. The float also has a third function, that of locking in the selection for a full flush after an initial drop in water level.

In this device the float is not stopped to obtain a full flush as it must continue down to terminate the full flush.

In order to obtain a full flush, I have devised a retractable operator between the float and valve operator which allows passage of the float beyond the water saving cut-off point without operating the valve. This is moved into retracted or disabled position by the flush control and held there by the float after a drop in water level so that the flush control can be released and still get a full flush.

This invention eliminates the conventional float type flapper valve as the same float for the water saver also operates for a full flush.

My retractable operator arrangement for obtaining a full flush is also usable in attachments for existing flush tanks. One way of applying it is disclosed in this application.

BRIEF DESCRIPTION OF THE DRAWINGS

FIG. 1 is a front view of the Water Saver shown located in a standard flush tank.

FIG. 2 is a top view of FIG. 1.

FIG. 2A is an enlarged section of the mounting hub arrangement for the latch and float lever shown in FIG. 2.

DETAILED DESCRIPTION

Figure 3:
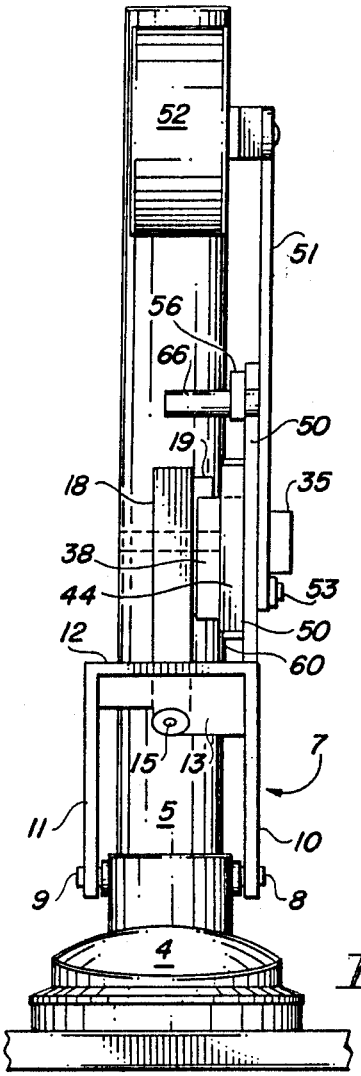
FIG. 3 is a side view of the mechanism shown in FIG. 1.

Referring to FIG. 1, reference character 1 indicates generally an outlet fitting for a flush tank having a bottom 2. This outlet fitting includes a large outlet 3 for the flush water having an inclined valve seat 4 and an overflow pipe 5. This outlet fitting is held in place by a nut (not shown) and sealed by a washer 6 which spaces the main part of the fitting from the bottom 2 of the tank. A valve lever generally indicated as 7 is mounted on pivots 8 and 9 formed on the outlet fitting 1. This valve lever includes legs 10 and 11 on opposite sides of the overflow pipe, leg 10 being mounted on pivot 8 and leg 11 being mounted on pivot 9 (FIG. 3). Legs 10 and 11 are joined at their ends by a cross member having a downwardly extending portion 12 as seen in FIG. 1 and an upper surface 13. This cross member is formed with a downward extension 15 carrying a flat flapper valve member 16 arranged to close the valve seat 4. This valve member 16 is made of soft rubber and needs no float portion as in conventional flapper valves. Attached to the lever cross member surface 13 is a latching extension 18 which extends upwardly at an angle as seen in FIG. 1. At its upper end this extension 18 is formed with a forwardly extending portion 19.

In this embodiment of the invention, the outlet fitting 1 also includes a float chamber 20 molded integrally with the outlet fitting 1. This float chamber is joined to the main part of the outlet fitting by a cross member 21. Attached to the latching section 18 by a pivot 23 is a pry-bar lever generally indicated as 24. This pry-bar lever includes a section 25 which bears against the top of cross piece 21, a stop portion 26 extending downwardly and an operating portion 27 which extends to the right of pivot 23 and downwardly. This operating section is connected by a chain 28 to the usual flush lever control 30. This flush control 30 is of usual construction and is carried by a pivot (not shown) passing through the front of the flush tank and having a handle which is depressed by the user when a flush is desired.

The rest of the working parts for the water saver are mounted on a pin 31 which is press fit through holes formed in the overflow pipe providing a water tight seal. This pin as shown in enlarged FIG. 2*a* is formed with a flange 32 abutting the overflow pipe 5 and an extension 33 which serves as a bearing for a latch hub 34 and a float lever hub 35.

Figure 4:
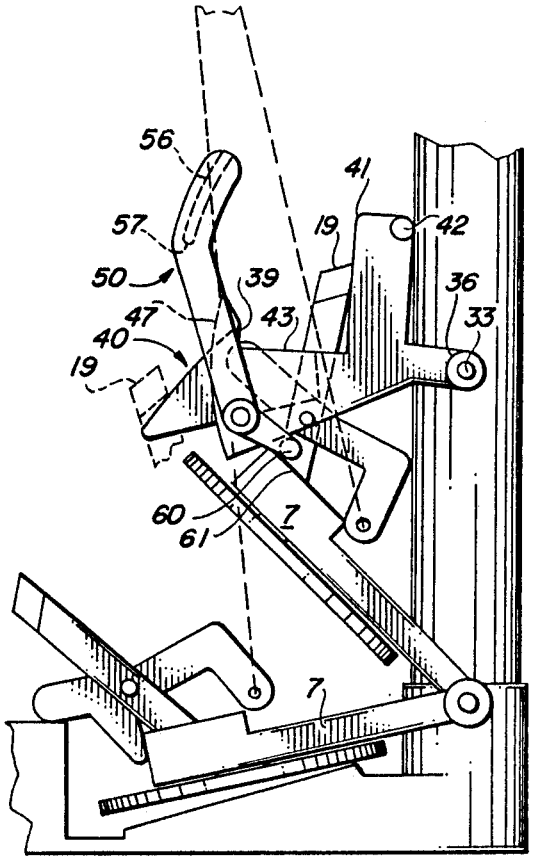
FIG. 4 is a fragmentary front view similar to FIG. 1 but showing the operation for starting a flush.

The latch hub 34 carries thin neck portion 36 (FIG. 4) which extends through a slot 37 in the float lever bearing 35. The neck portion 36 supports the main latch member generally indicated as 38. This is better shown in FIG. 4 which omits the float lever. This latch member 38 includes a latching surface 39 in the path of the latching portion 19 of flapper valve operator 7. The latch member also includes a camming surface 40 which merges with the surface 39, and a stop arm 41 carrying a stop pin 42 which engages the overflow pipe 5 for limiting upward rotation of the latch 38 about its pivot 33. The latch sections 39 and 41 are joined by a flat surface 43. The part of the latch member so far described controls the valve operator 7, holding it up when the latch is engaged and releasing it to close the valve when the latch is disengaged. This latch member also includes ah operating portion 44 (FIG. 3) extending forwardly of latching section 38. The surface 43 is common to both sections of the latch member. The operating beyond the latching surface 39 and having a blocking surface 47 which is a radius about the pivot pin 33. This operating surface 43 of the latch member is actuated by an operator 50 which is bodily carried by float lever 51 which is attached to the float lever hub 35 and carries a float 52. The operator 50 is located between the float lever 51 and the operating section 44. This operator is molded with a bearing pin 53 which extends through a mounting hole in the float lever and carries a press-on retainer 54 for holding the operator in place. The operator has an upward extension 55 carrying a curved rearward projection 56 having a leading edge 57. This rearward projection extends over the operating section 44 of latch member 38. Operator 50 also has a downwardly extending lever portion 59 extending beyond the bottom of the latch and is formed with an inwardly extending pin 60 which extends into the path of the top surface 61 of the valve operator 7.

The latch member 38 is biased upwardly by a torsion spring 63 carried by the hub 34. (see enlarged FIG. 2A). One end of this torsion spring extends through the slot 37, hub 35 and bears on a pin 64 forming part of the latch member 38. The other end of the torsion spring is bent inwardly and fits in a slot in a washer 65 which is pressed on shaft 33. This torsion spring biases the latch member 38 upwardly into latching position in which pin 42 on the latch engages the overflow pipe 5.

The float lever includes an inwardly extending operating pin 66 which just engages overflow pipe 5 when the tank is full. This pin stops upward movement of the float lever at the full tank position. In installation the regular inlet valve for the flush tank is adjusted to bring the level to this point.

OPERATION OF EMBODIMENT FIGS. 1–8

FIG. 1 shows the parts in the positions assumed before a flush. The tank is full and the float lever is at its top position where operating pin 66 engages overflow pipe 5. The latch member 38 is at its upper position where pin 42 engages the overflow pipe. The flapper valve is closed and the pry-bar lever 24 has its end portion 25 engaging stationary surface 21 with a gap between portion 26 of the lever and the end 12 of the valve operator. The flush lever 30 is in its down position allowing the valve lever 7 to assume the position shown. At this time the upper section 55 of operator 50 is engaging the top of extension 41 of the latch 38.

When a flush is desired, the user depresses the external flush lever (not shown) which raises the flush lever 30 pulling the end 27 of the pry-bar lever upwardly. This causes downward movement of the portion 25, lifting pin 23 of the valve lever upwardly with mechanical advantage. This mechanical advantage makes it easier to break the valve member 16 loose from its seat. After the valve member is pried loose, portion 26 of the pry-bar lever engages the end 12 of the valve lever 7 and the parts now move as if they were one piece.

When the external flush lever is completely depressed, the internal lever 30 assumes its upper position as shown. This causes the parts to assume the positions shown in FIG. 4. At this time valve lever 7 is at its top position and the latching section 19 of the valve lever engages the latch extension 41, being well beyond the latching surface 39 of the latch. The upper surface 61 of valve member 7 has engaged pin 60 of the latch operator 50 causing the operator to assume its counter clockwise end position in which the leading edge 57 of the rearward extension is to the left of blocking surface 47 on the latch. During this flushing motion, the latch portion 19 on the valve operator contacted the camming surface 40 of the latch moving it downwardly allowing continued movement of latch portion beyond the latching surface 39

WATER SAVER FLUSH

Figure 5:
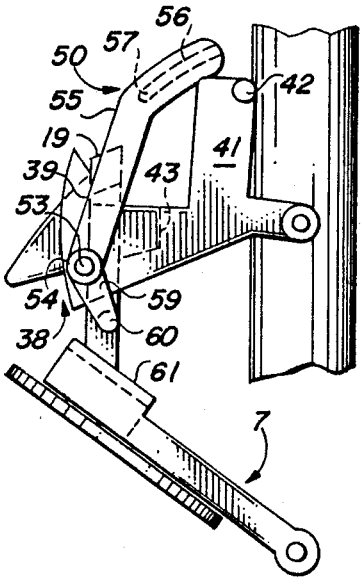
FIGS. 5, 6, 7 and 8 are fragmentary front views showing the parts in the different locations assumed during a normal flush cycle.
Figure 6:
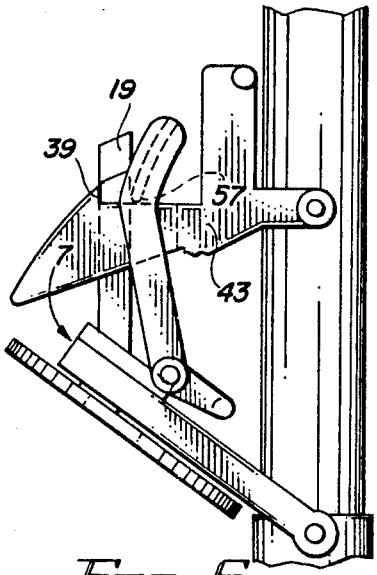

If the user desires a short water saver flush, the external flush handle is released immediately. This allows downward movement of the valve lever 7 to the position shown in FIG. 5 where the latching section 19 on the valve lever engages the latching surface 39 on the latch. The valve is now held open by the latch. When the water level approaches the water saver cut-off point the leading edge 57 on operator 50 engages surface 43 of the latch and pushes it downwardly. At the cut-off point, latching surface 39 of the latch disengages the latching section 19 of the valve lever 7 as shown in FIG. 6 allowing the valve to snap closed, terminating the flush at the intermediate water saving level.

FULL FLUSH

Figure 7:
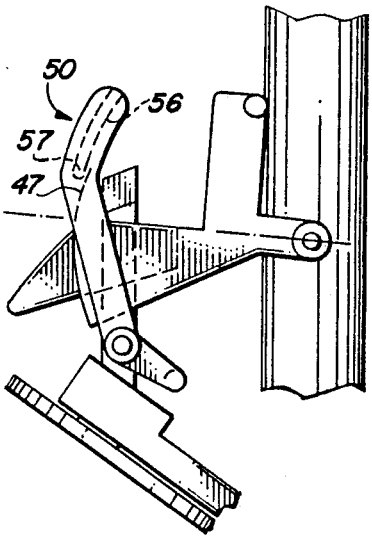
Figure 8:
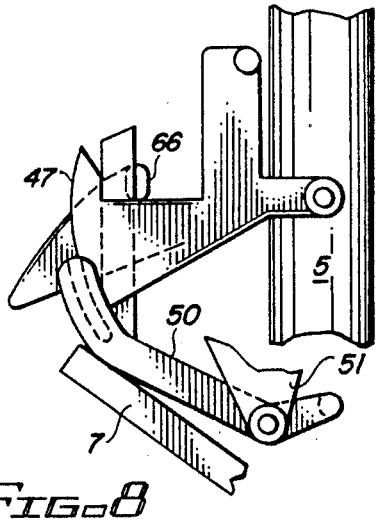

If the user desires a full flush, the external handle is held down for approximately 2 seconds. This holds the operator 50 in its retracted or disabled position of FIG. 4, due to contact of top surface 61 of lever 7 with pin 60 of the operator. Now when the external flush lever is released, the parts assume the position of FIG. 7. The operator 50 is prevented from reaching its operating position by the blocking surface 47 engaging the curved rearward extension 56. The latch continues to hold the valve lever in open position and the flush continues to its bottom cut-off point as shown in FIG. 8. At this time the operating pin 66 on the float lever releases the latch and the valve closes. The curved rearward extension on the latch operator remains in engagement with the blocking surface 47 insuring free upward movement of the float lever as the tank refills.

As the float approaches its bottom cut-off point it enters the chamber 20 at the bottom of the tank. Due to the metering orifice 69, the water level in the chamber drops slower than the water level in the tank itself. This keeps the float from reaching its bottom cut-off position until the tank is completely empty.

From the foregoing it will be apparent that in this invention a single float provides three separate functions. The float in combination with operator 50 and latch 38 provides a closing means for the valve to provide a water saver flush. The same float in combination with float lever pin 66 and, the latch provides a closing means for a full flush. The operator 50 is retractable from its operating position and held disabled by blocking surface 47 if the external flush lever is held down until the float drops to the selector level. Thus the float also serves to lock in the selection for a full flush, allowing the flush handle to be released.

It should be noted that flush lever 30 is operated by the user to select between a partial flush and a full flush. This lever in combination with the mechanism responding to the lever operation constitute a selective means controlled by the user for selecting between partial flush operator 50 and full flush float pin 42 for releasing the latch.

FIGS. 9–14

Figure 9:
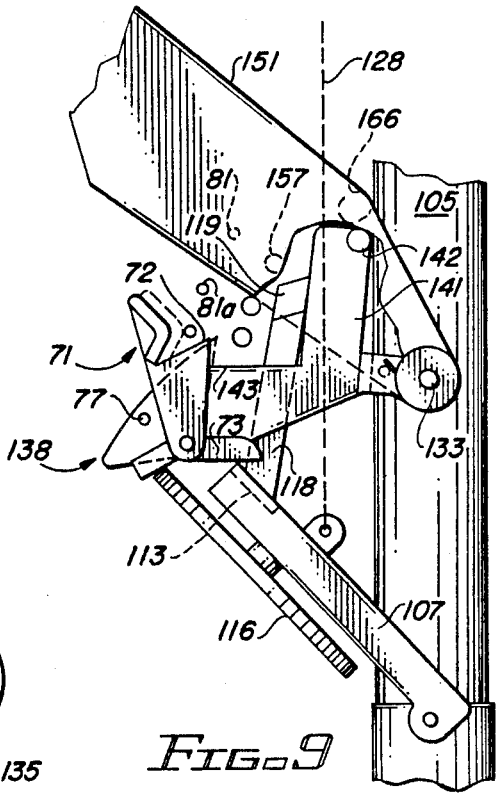
FIG. 9 is a fragmentary front view of a modification.

In the first embodiment of the invention the operator for the latch is carried bodily on the float lever and is disabled from operating the latch by retracting it to a position missing the operating surface of the latch. In the embodiment to be described the operating surface for the latch is on a separate part bodily carried by the latch and is retractable to a position in which it is missed by a water saver pin on the float lever. FIG. 9 is a fragmentary view of the mechanism shown in FIG. 1 but including this modification. In the disclosure of the embodiment of FIGS. 9–14, parts corresponding to the parts in the first embodiment are given the same reference characters plus 100.

Figure 13:
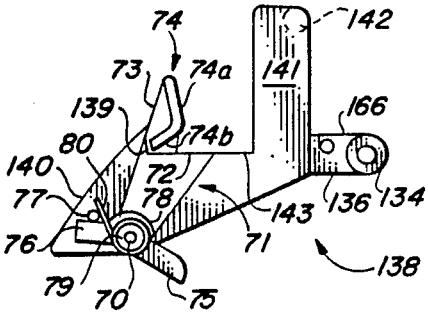
FIG. 13 is a front view of the latch and operator assembly.
Figure 14:
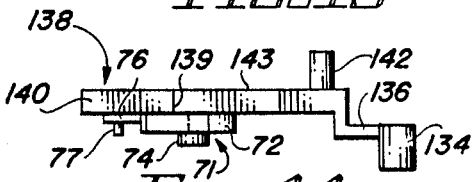
FIG. 14 is a top view of FIG. 13.

The primary difference between the two embodiments is in the use of a special latch and operator sub-assembly shown separately in FIGS. 13 and 14. This sub-assembly replaces the latch construction 38 and the float operator 50 of FIG. 1.

Referring to FIGS. 13 and 14 the latch includes a hub 134 joined to a neck 136 supporting the main latch body 138 having a latching surface 139 joining a camming surface 140 and a flat surface 143 merging with a stop section 141 and carrying a stop pin 142. This construction is the same as the latching section of the first embodiment.

Extending forwardly from the front of latch 138 is a pivot pin 70 carrying a retractable latch operator 71. This operator is formed with an upwardly facing surface 72 which matches surface 143 of the latch when in the position shown in FIG. 13. This operator also includes an upward extension 73 carrying an outwardly extending selector portion 74 having a downward extension **74*a* joining a leftward extension 74*b*. The operator member 71 also includes an actuating lever 75 extending downwardly to the right as shown in FIG. 13. It also includes a stop extension 76 extending to the left and contacting a stop pin 77 formed on the latch. Member 71 is also formed with a recess 78 and a forwardly extending hub 79 which fits over the pin 70 on the latch member. This hub carries a torsion spring 80 having one end bearing on the stop pin 77 and its other end bearing on the edge of recess 78. This torsion spring biases the operator 71 clockwise, causing it to assume the position shown in FIG. 13 where the stop arm 76 engages the stop pin 77 and the upper surface 72 matches the upper surface 143** of the latch member.

The float lever 151 is similar to float lever 51 of FIG. 1. However it is simplified as the pivot pin 53 of FIG. 1 has been eliminated. This float lever carries an inwardly extending pin 157 for actuating the latch at the water saving level, and a second pin 166 for actuating the latch at the end of a full flush. Lever 151 also carries a selector pin 81 for controlling the operator 71 on the latch.

OPERATION OF FIGS. 9–14

FIG. 9 shows the parts in the positions assumed at the instant a flush started. The user has operated the external flush lever to pull upwardly on the chain 128 which lifts valve lever 107' to the point where the latching extension 119 of the valve lever has engaged upward extension 141 of the latch. The crossover member 113 of valve operator 107 has engaged the lever portion 73 of operator 71, rotating it to the retracted or inoperative position shown in which surface 72 is out of the path of the float lever pin 157.

Figure 11:
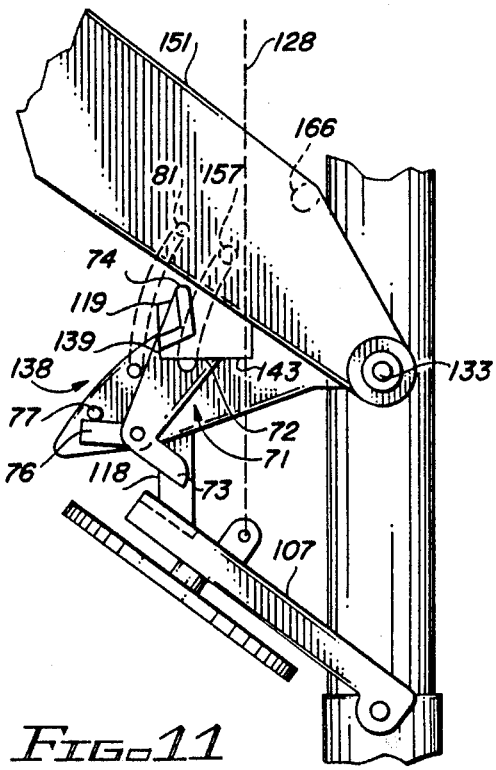
FIG. 11 is a view similar to FIG. 9, but showing the parts in different positions.

If the user wishes a short flush, the flush handle is released immediately, allowing the valve lever 107 to drop to the position shown in FIG. 11 in which the latching extension 119 engages the latching surface 139 of the latch. The outlet valve is now held open solely by the latch 138. The lever 73 of the latch operator is no longer held up by the valve lever and this operator returns to its normal position in which stop lever 76 engages the stop pin 77 and operating surface 72 is in alignment with surface 143 on the latch.

Figure 10:
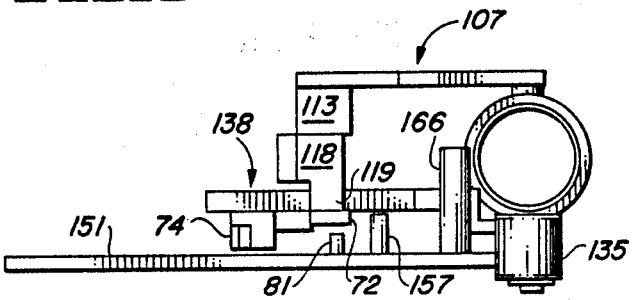
FIG. 10 is a top view of FIG. 9

As the water level drops, the float lever 151 rotates counterclockwise causing water saver pin 157 to approach surface 72 of the latch operator. As the pin 157 passes the operator extension 74 it cams it out of the way and then allows it to come back to the normal position shown. At the water saver level, pin 157 engaging upper surface 72 causes the latch 138 to release extension 119 of the valve operator, allowing the valve to close. As this is going on the selector pin 81 on the float lever is to the left of extension 74 on operator 71. It should be noted that as shown in FIG. 10 the selector pin 81 is short so that the only part of the operator it affects is extension 74. The pin 157 is long enough to contact the operating surface 72.

Figure 12:
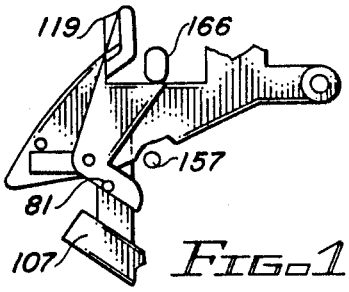
FIG. 12 is a fragmentary view showing the parts at the end of a full flush cycle.

If the user wishes a full flush, the external flush lever is held depressed until the water level reaches the selector level as shown in FIG. 1. At this time the selector pin 81 on the float lever has reached the position **81*a* in FIG. 9. It is now in position to block the return of operator 71 to active position. This pin is engaged by the selector extension 74. As the water level drops, the pin 81 cams operator 71 to the left and holds it in disabled position as the water saver pin 157 on the float lever approaches the latch. In effect the operator is out of the path of the pin 157 and the latch is not released at the water saver level. On dropping water level, the selector pin 81 disengages extension 74 and allows the operator to return to its normal position as shown in FIG. 12. At the end of a full flush, the pin 166 on the float lever engages both the operator and the latch itself, pushing the latch down and releasing latch extension 119** to allow the valve to close.

As the tank refills, the float lever 151 rises and the pins 81 and 157 pass by the operator extension 74. The configuration of extension 74 into the sections **74*a* and 74*b* allows the pins 81 and 157 to pass by without binding on the extension 74**.

FIGS. 15–17

Figure 15:
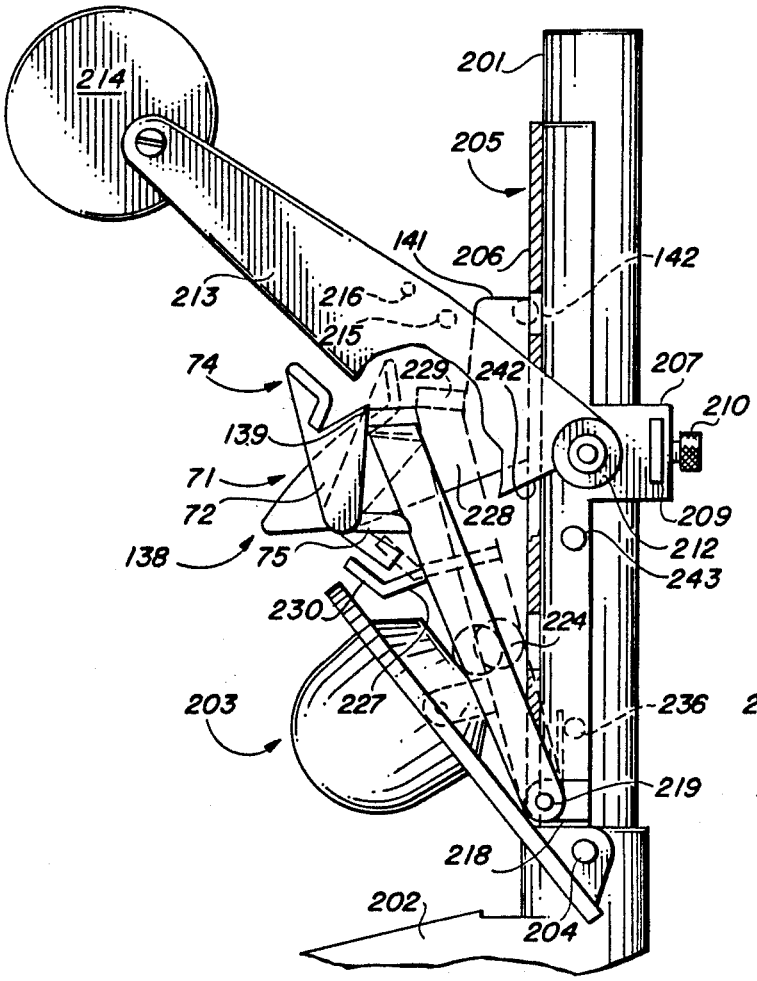
FIG. 15 is a front view of a mechanism shown in FIGS. 9–14 but applied to an attachment for existing flush tanks.
Figure 16:
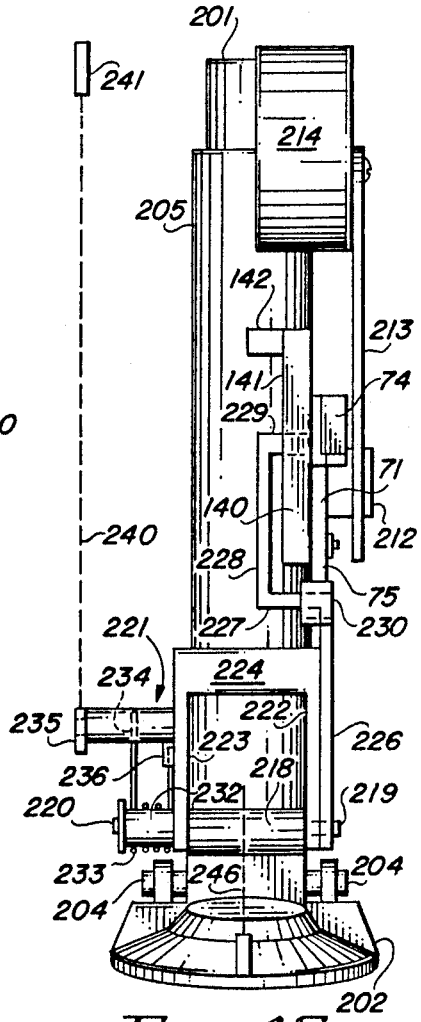
FIG. 16 is a side view of FIG. 15 but with the flush valve closed.
Figure 17:
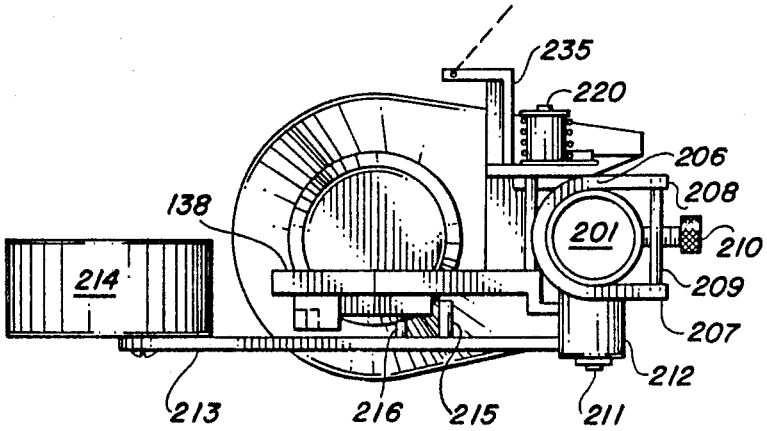
FIG. 17 is a top view of FIG. 15.

The latch and operator sub-assembly shown in FIGS. 13 and 14 is also usable in a water saver accessory for existing flush valves as shown in my application Ser. No. 07/067494 filed June 29, 1987. This is shown in FIGS. 15, 16, and 17. This accessory mounts on the usual overflow pipe 201 of a flush tank outlet valve including a valve seat 202 closed by a pivoted float type flapper valve 203 carried on pivots 204.

The water saver attachment is carried on a base member 205 mounted on overflow pipe 201. This base member consists of an elongated semi-circular member 206 (FIG. 17). This semi-circular member fits over the overflow pipe 201 and extends from the bottom of this pipe to the water level as shown in FIG. 15. Near the center of member 206 are two rearward extensions 207 and 208 supporting a clamping member 209 carrying a thumbscrew 210. Tightening of this thumbscrew holds base member 205 in firm engagement with the overflow pipe. Extending from the base member 205 is a pivot pin and flange 211 similar to that shown in detail in FIG. 2*a*. This pivot pin carries the hub 134 of the latch member 138 (FIG. 14). It also carries the float lever hub 212 supporting float lever 213 carrying float 214. This float lever carries an operating pin 215 and a selector pin 216 which are identical to parts 157 and 81 of FIG. 10.

At the bottom end of semi-circular member 206 is a forwardly extending boss 218 carrying pivot pins 219 and 220. These pivot pins support a valve operator generally indicated as 221 which is similar to that shown in detail in my application Ser. No. 07/067494. This valve operator includes two downwardly extending legs 222 and 223 fitting over pins 219 and 220 respectively. The legs 222 and 223 are joined by a cross member 224 which extends across the front of the overflow pipe behind the flapper valve 203. Attached to the valve operator leg 222 is a latching lever 226. This lever extends upwardly to an offset portion 227 extending inwardly to an upwarding extending portion 228 carrying an outwardly extending latch portion 229 arranged to engage the latching surface 139 of the latch.

The inwardly extending portion 227 of the latch lever extends to the left as seen in FIG. 15 and then upwardly at 230 under the lever section 75 of latch operator 71.

Referring to FIGS. 16 and 17, the left hand leg 223 of valve operator 221 carries an extended hub 232 carrying a torsion spring 233. One end 234 of this torsion spring bears on an operating arm 235 which extends sideways as shown in FIG. 16 and then forwardly as shown in FIG. 17. The other end of the torsion spring 233 bears on a pin 236 forming part of the base 205. This spring 233 serves to urge the valve lever in a counter clockwise direction as seen in FIG. 15 for pushing the flapper valve 203 to closed position. The end of lever 235 is attached by a suitable chain 240 to the internal flush lever 241. This flush lever is also connected by the usual chain 246 to the flapper valve 202.

OPERATION OF FIGS. 15–17

When the external flush lever is depressed to start a flush the internal lever 241 rises. This opens the float type flapper valve in the usual manner. It also through chain 240 and lever 235 rotates the valve operator to the position shown in the dotted lines of FIG. 15. Movement of the valve lever is stopped by engagement of latching section 229 with the upward extension 141 of the latch 138. The extension 230 of latch lever 226 comes under the latch lever portion 75 of operator 71 rotating it to its retracted or disabled position. This is the same position as shown in FIG. 9.

If the user wishes a short flush, the external float lever is released immediately and the internal lever 241 drops allowing counterclockwise movement of the latch lever 226 to its full line position causing the latching extension 229 to engage latching surface 139 of the latch. This movement withdraws the operating section 230 of the latch lever from under section 75 of the latch operator, allowing this operator to assume its active position the same as in FIG. 11. The operating pin 215 and the selector pin 216 on the float lever now function exactly as the corresponding pins 157 and 81 of FIG. 11 and the latch is released when the water saving level is reached.

Release of the latch allows the torsion spring 233 to drive the valve lever counter clockwise as seen in FIG. 15 pushing the flapper valve 203 down to the point where the down rushing water causes the valve to snap closed.

If the user wishes a full flush the external flush lever is held down for approximately two seconds until the drop in water level brings the pin 216 into position where it blocks return movement of latch operator 71. The operation is exactly the same as described for FIG. 11, the operator being held out of the path of the water saver pin 215 and allowing the float to drop without operating the latch. The water level continues to drop until the float type flapper valve is no longer bouyant and drops closed. If desired the float lever may be formed with a stop surface 242 engaging a stop in 243 on the base for stopping movement of the float lever after it has passed the water saving operating point.

I claim:

1. In a water saver for a toilet flush tank having a bottom, an outlet with a valve seat, a valve for controlling the outlet and a flush control operated by the user for opening the valve to start a flush, the combination of, a float movable with water level, first closing means operated by the float for closing the valve at an intermediate water saving level, second closing means operated by said float for closing the valve at the end of a full flush, and selective means controlled by the user for selecting which closing means shall be operative.

2. The combination recited in claim 1 in which the selective means includes the float.

3. The combination recited in claim 2 in which the selective means is constructed and arranged to disable the first closing means when the water level drops to a predetermined level while the user holds the flush control in flushing position.

4. The combination recited in claim 1 including a chamber at the bottom of the tank into which the float enters at the end of its movement, and a metering passage from the chamber into the main portion of the tank, the water in the chamber delaying downward movement of the float.

5. The combination recited in claim 1 in which the first and second closing means include a single latch common to both means and a member held by the latch, releasing of said member, by the latch causing closure of the valve.

6. The combination recited in claim 5 in which the selective means is operated by the flush control to disable the first means, and means responsive to a drop in water level for locking the first means disabled, permitting release of the flush control.

7. The combination recited in claim 5 including a pry-bar lever operated by the flush control and moving with the valve, said pry-bar lever being constructed and arranged to provide mechanical advantage for the flush control in breaking the valve loose from its seat.

8. In a water saver for a toilet flush tank having an outlet, a valve for controlling the outlet and a flush control operated by the user for opening the valve to start a flush, the combination of, a float movable with water level, closing means actuated by downward movement of the float to an intermediate water saving level for closing the valve, said closing means including retractable means which when retracted allows downward movement of the float without closing the valve, and means operated by the user for causing said retractable means to be retracted when a full flush is desired.

9. The combination recited in claim 8 in which the retractable means includes a driving part moved by downward motion of the float and is retracted to an inactive position.

10. The combination recited in claim 8 including a driving part moved by the float through a path and a driven part contacted and actuated by the driving part, said retractable means moving the driven part out of the path of the driving part.

11. The combination recited in claim 8 including means operated by the flush control when in flushing position for holding the retractable means in retracted position.

12. The combination recited in claim 11 in which means controlled by the float locks the retractable means in retracted position when the water level drops to a point above the water saving level.

13. In a water saver for a toilet flush tank having an outlet, a valve for controlling the outlet and a flush control operated by the user for opening the valve to start a flush, the combination of, a lever controlling the valve, a latch arranged to hold the lever is valve open position, release means for the latch for providing a water saving flush, said release means including a float and an operating means, said operating means having an operating position in which the float causes release of latch and a retracted position which allows movement of the float without releasing the latch, and means operated by the user for causing the operating means to be in retracted position when a full flush is desired.

14. The combination recited in claim 13 in which the lever is moved into position to be held by the latch by the flush control.

15. The combination recited in claim 14 in which the lever is moved beyond that held by the latch by the flush control and means responsive to such movement for retracting said operating means.

16. The combination recited in claim 15 in which release of the flush control by the user allows return, movement of the lever to its position held by the latch, and means actuated by such return movement for moving the operating means from retracted position to operating position.

17. The combination recited in claim 16 in which means actuated by the float on drop in water level to a predetermined point prevents the operating means from moving from retracted to operating position.

18. The combination recited in claim 17 in which the operating means is bodily carried by the latch and has a first surface actuated by the float when in operating position, said operating means also having a second surface actuated by the float for holding the operating means in retracted position.

19. In a toilet flush tank having an outlet, a valve for controlling the outlet, and a flush control operated by the user for opening the valve to start a flush, the combination of, a float movable with water level, closing means operated by the float for closing the valve as the water level in the tank approaches the bottom of the tank, a chamber at the bottom of the tank into which the float enters at the end of its movement and a metering passage from the chamber into the main portion of the tank, the water in the chamber delaying downward movement of the float.

20. In a toilet flush tank having an outlet seat, a valve for controlling the outlet seat and a flush control operated by the user to start a flush, the combination of a lever arranged to pull the valve from its seat and hold it open, a latch arranged to hold the lever in valve open position, float means for releasing the latch to terminate a flush, and connecting means between the flush control and lever, said connecting means including a pry-bar pivoted to the lever and extending from both sides of the pivot, one side of the pry-bar being connected to the flush control and the other side bearing on a stationary surface to give the flush control mechanical advantage in breaking the valve loose from the outlet seat.

* * * * *